United States Patent [19]

Rosello Zoya

[11] Patent Number: 4,752,261

[45] Date of Patent: Jun. 21, 1988

[54] AUXILIARY SEAT FOR SURFBOARDS

[76] Inventor: Miguel A. Rosello Zoya, Almirante Cadarso, 12, 40005 Valencia, Spain

[21] Appl. No.: 897,712

[22] Filed: Aug. 18, 1986

[30] Foreign Application Priority Data

Aug. 19, 1985 [ES] Spain ..... 288.719

[51] Int. Cl.[4] ..... B63B 35/72

[52] U.S. Cl. ..... 441/74; 440/104; 114/363

[58] Field of Search ..... 114/363, 39.2; 440/104, 440/105; 441/74, 65

[56] References Cited

U.S. PATENT DOCUMENTS 2,147,958 2/1939 Angers ..... 114/363

FOREIGN PATENT DOCUMENTS 2654618 6/1978 Fed. Rep. of Germany ..... 440/105
2938211 4/1981 Fed. Rep. of Germany ..... 440/104
3016857 11/1981 Fed. Rep. of Germany ..... 440/105
3104301 8/1982 Fed. Rep. of Germany ..... 114/39.2
58-211997 12/1983 Japan ..... 114/39.2

OTHER PUBLICATIONS

Palazzi, European Patent Application, 11/84.
Bambridge, UK Patent Application, 4/81.

*Primary Examiner*—Joseph F. Peters, Jr.
*Assistant Examiner*—Edwin L. Swinehart
*Attorney, Agent, or Firm*—Ladas & Parry

[57] ABSTRACT

An auxiliary seat for a surfboard comprises a rectangular tube-form frame having two U-shaped sections telescopically connected to form the longer sides of the rectangle. A first section has a raised end for a footrest. A second section has a third U-shaped tube-form frame connected thereto to form a foldable back. Two crossmembers are fastened to the frame for attaching it to a surfboard. Expandable sleeves couple one of these crossmembers to a mast housing and the other to a casing on the surfboard.

4 Claims, 3 Drawing Sheets

AUXILIARY SEAT FOR SURFBOARDS

The present application describes an auxiliary seat for surfboards.

The more and more increasing use of surfboar ds and the difficulties implied by their use alone or with a sail for many people, has lead to the study for the transformation of such surfboards into simple crafts usable with propellent oars.

Although it is true that some "surfers" who are skilled and well-trained, are in the position to steer these boards without a sail, standing up and with a double oar to propel them, it is also true that this use is even more questionable for people who are less skilled or even children.

Considering all of these problems, the invention proposes to optionally transform a conventional surfboard into an oar-type surfboard, and for this purpose, a seat which has been adapted to the board in such as way that absolutely no modification thereof is required, has been studied, given that it is to be subsequently used with the conventional propellent sail means and with the help of the corresponding board.

To this effect the use of the openings for the coupling of the mast and of the board has been considered for the fastening of the seat.

For this purpose said seat has been built by means of a rectangular tube-form frame whose dimensions are adapted approximately to the width of the board, while longitudinally it is foreseen to be extendable to adapt it to different lengths, suiting itself to the user's needs.

The provision of a tip-up back, located at one end of the frame, while the other end has been shaped like a footrest bar, has been provided for greater comfort.

The frame is equipped with cross members which are the holders of the parts, for fastening to the board. Among fastening parts lined elastic sleeves which are expanded by axial compression have been chosen as the most suitable ones. This is done in such a way that upon being inserted in the mast and board housings, they secure the correct position of the frame with their expansion.

The cross members holding the fastening parts can move along the frame to make the fastening parts coincide with the mast and board housings, depending on the type of board.

It has been foreseen that the cross members can be fastened to the frame in the chosen position. The system of threaded sleeves with inside flexible clamps, which makes it possible to eliminate any projection beyond the frame, has been chosen as the most suitable means.

The seat itself as well as the back will be made up of laminar parts, sewn or fastened by another means, but with enough resistance for the proposed purpose.

It is foreseen that an auxiliary footrest bar can be coupled, when the board is going to be used with the seat built in for children for the purpose of reducing the space from the seat and so that one can comfortable rest one's feet.

The including of stabilizer support frames or rowlocks has also been foreseen to secure the position of the oars, above all when the board is to be used by beginners.

At the coupling of the frame to the board, it is possible to use other securing means, such as grips that clamp the longitudinal edges, though it has been considered that such parts break the waterline of the board, unless the board is provided with the corresponding slots for this purpose.

Just as expandable lined sleeves are used as means to fasten the mast and board to the housing, other means which substitute them may be used, as long as the keel surface is kept clear to facilitate the movement of the board and so that there is no possibility of rubbing against projecting parts that may hurt the user when the same has overturned, for example.

For this same reason an attempt has been made to give all of the parts making up the seat, a design of smooth curved lines without any projection.

In the same way that the seat is coupled to the board to convert it into an oar-type craft, the seat is removable, with identical ease for the normal use of the surfboard with a mast, sail and board.

As a non-restrictive example of the stated idea a practical embodiment of the seat in question has been represented on the sheet of drawings attached as a complement to this specification.

FIG. 1 shows the parts that make up the seat separate from one another and ready to be assembled viewed from the side. The tube-form frame consists of two parts -1- and -2-, telescopically mountable, provided with fastening means -3- and -4-, in their relative positions between parts determing its length. The frame -1- has another frame -5- built in, which is the frame of the back, which is jointed to the former by -6-. The frame -2- has its closed end -7- raised to form the footrest bar for the user. The sleeves -8- formed by nut -9- and clamp mouthpiece -10-, each one of them, are axially passed through by the frames, and the cross members -11 and -12- respectively, that provide the means for fastening the unit to the surfboard, form part of them. These fastening means are represented in this case by expandable elastic sleeves -13- and -14-, as the nut -15- is threaded to the stud enveloped by the sleeve.

Figure 1:
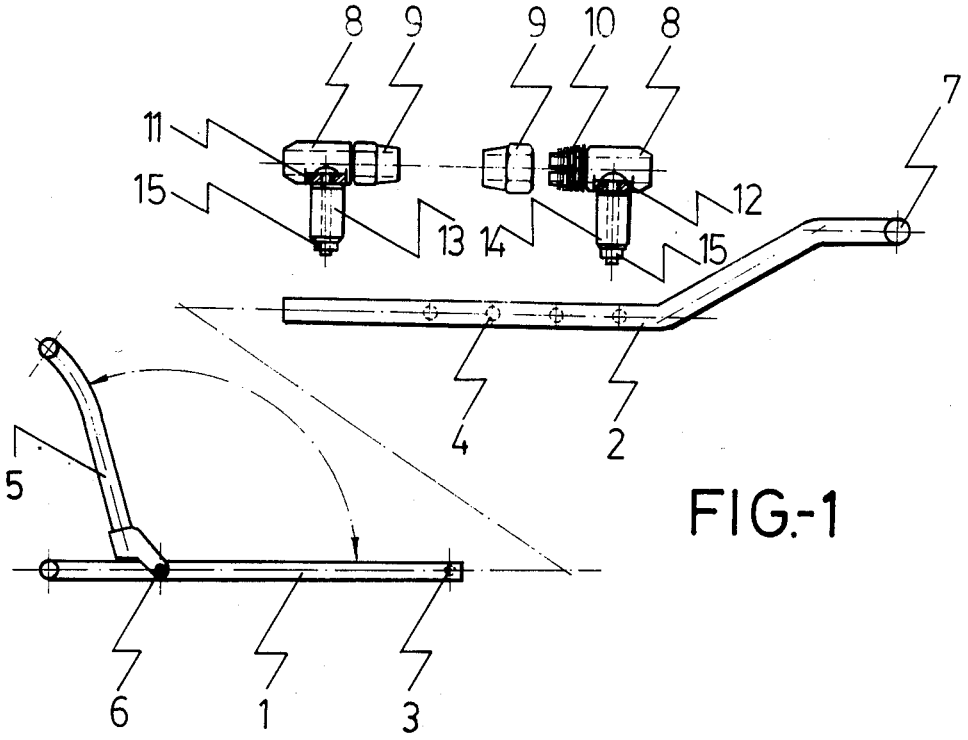
Figure 2:
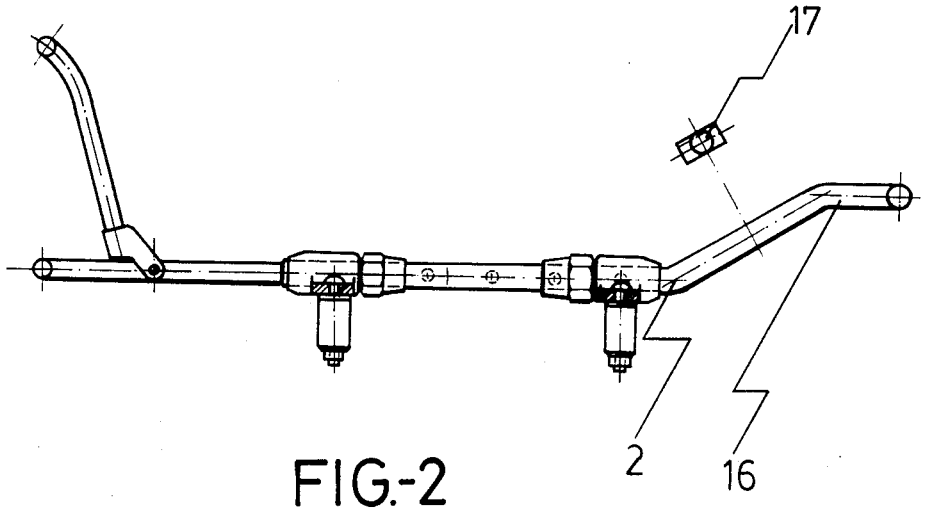
FIG. 2 shows the frame assembled. A supplementary crossbar -17- can be placed over the inclined extension of the frame -2- so that when the seat is used by a child, said child may rest his feet comfortably.
Figure 3:
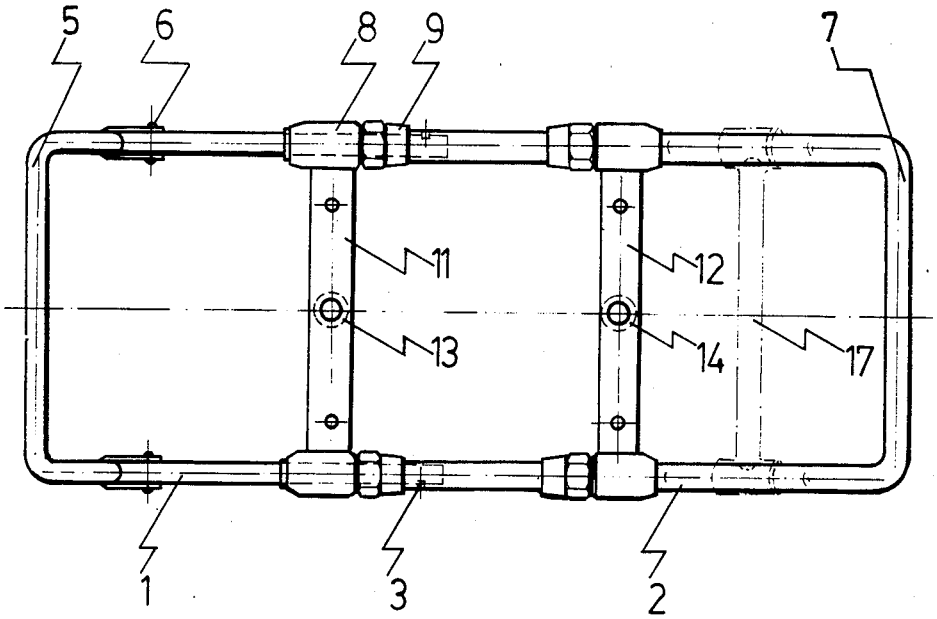
FIG. 3 shows a plan view of the seat and the dash line represents the crossbar -17-.
Figure 4:
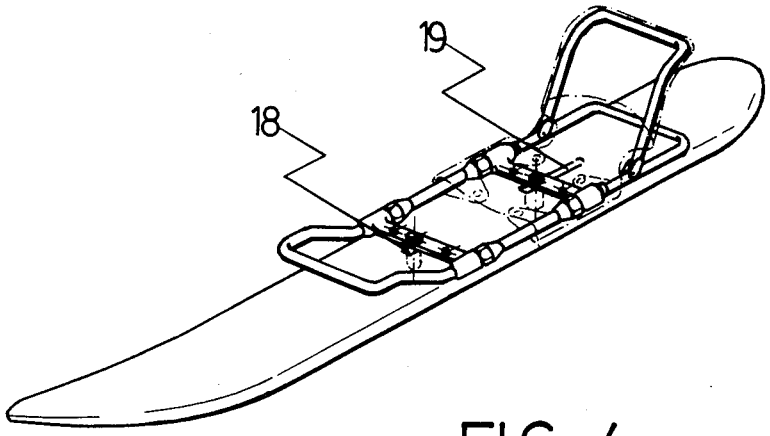

FIG. 4 represents a perspective view of the seat mounted on a surfboard. It is shown how the expandible elastic sleeves coincide with the position of the housing -18- of the mast and with the board casing -19-, due to the fact that the cross members can move all along the frames. The body of the seat -20- and the body of the back -21- are represented by the dash lines.

Figure 5:
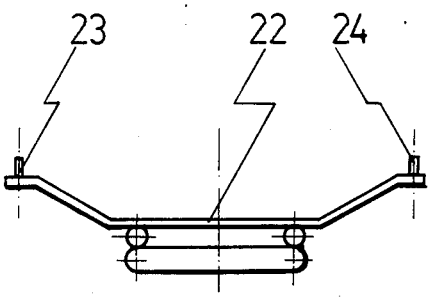

FIG. 5 corresponds to a diagram in which an example of arrangement of a supplementary frame -22- provided with rowlocks -23- and -24- to rest the independent oars is shown.

Figure 6:
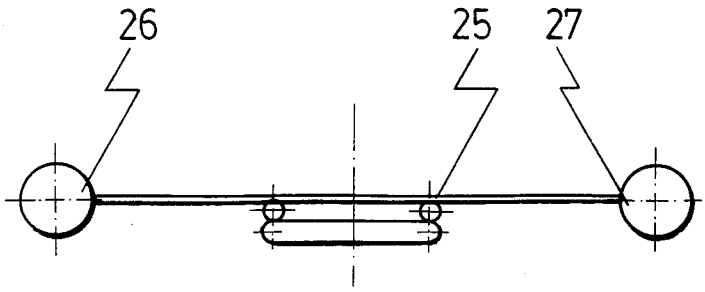

Finally, FIG. 6 represents a diagram of a frame -25- provided with stabilizers -26- and -27- too.

The possibility of placing the rowlocks and the stabilizers in a single frame also exists.

From all of the above it is inferred that the essential part of the invention is being able to transform a surfboard into a craft in which the user is comfortably seated and uses oars to move ahead, without it being necessary at all to modify the surfboard, and without affecting its waterlines, as the seat is removable and in the absence thereof, the surfboard will be able to be used with its mast and sail, as well as with its board.

The part of the seat itself that corresponds to ref. 1 will be able to move with regard to the support, in other words, it can have a superimposed seat that is moved when the surfboard is used as a "skiff" and a tie will be placed on the footrest -7- for greater safety preventing one's feet from moving.

I claim:

1. An auxiliary seat for a surfboard comprising:

(a) a tube-form rectangular frame having two U-shaped sections telescopically connected to form longer sides of said rectangle by means to adjust the length of said longer sides, a first section of said frame having a closed end raised to form a footrest for a user, a second section having a foldable back connected thereto, said foldable back comprising a third U-shaped tube form frame;

(b) means for fastening said frame to a surfboard comprising two cross members on said frame, each of said crossmembers being connected to said frame by a pair of threaded sleeves for adjusting their position on said frame, a first crossmember being attached to said first section of said frame and having a first expandable sleeve for fastening said first crossmember to a mast housing on said surfboard, a second crossmember being attached to said second section of said frame and having a second expandable sleeve for fastening said second crossmember to a casing on said surfboard.

2. The auxiliary seat of claim 1 further comprising a transverse frame supporting rowlocks for oars.

3. The auxiliary seat of claim 1 further comprising a transverse frame for stabilizing floats.

4. The auxiliary seat of claims 1 further comprising a third crossbar for a footrest for a child.

* * * * *